US008230938B2

(12) United States Patent
Huang

(10) Patent No.: US 8,230,938 B2
(45) Date of Patent: Jul. 31, 2012

(54) FIRE PREVENTION ASSEMBLY

(75) Inventor: Chun-Chien Huang, Tainan County (TW)

(73) Assignee: Uangyih-Tech Industrial Co., Ltd., Taipei (TW)

( * ) Notice: Subject to any disclaimer, the term of this patent is extended or adjusted under 35 U.S.C. 154(b) by 476 days.

(21) Appl. No.: 12/624,415

(22) Filed: Nov. 24, 2009

(65) Prior Publication Data

US 2011/0120735 A1 May 26, 2011

(51) Int. Cl.
*A62C 37/00* (2006.01)

(52) U.S. Cl. ..... 169/56; 169/60; 137/72; 454/369

(58) Field of Classification Search ..... 169/19, 169/56, 60, DIG. 3; 137/72, 74, 75; 236/49.2, 236/49.5; 454/369
See application file for complete search history.

(56) References Cited

U.S. PATENT DOCUMENTS

| | | | | |
|---|---|---|---|---|
| 3,633,600 | A * | 1/1972 | Sadamori | 137/77 |
| 5,533,929 | A * | 7/1996 | Attridge, Jr. | 454/369 |
| 6,336,510 | B1 * | 1/2002 | Gadini | 169/37 |
| 7,530,891 | B2 * | 5/2009 | Perrin | 454/369 |
| 8,062,108 | B2 * | 11/2011 | Carlson et al. | 454/369 |
| 2008/0141486 | A1 * | 6/2008 | Goates | 16/48.5 |

* cited by examiner

*Primary Examiner* — Jason Boeckmann
(74) *Attorney, Agent, or Firm* — Pai Patent & Trademark Law Firm; Chao-Chang David Pai

(57) ABSTRACT

A fire prevention assembly comprises a main body, a first connective unit, a tubular piece, a sensor unit, a second connective unit, a first flexible piece, a movable piece and a second flexible piece. The fire prevention assembly is installed to a fire prevention gate. In use, the sensor unit would melt at a high temperature. In such case, the tubular piece moves rearwards along with the movable piece. Therefore, the movable piece will no longer limit the movement of the position limiting plate of the fire prevention gate and the protective plates will be allowed to rotate to open or close the fire prevention gate. Consequently, the fire prevention assembly can provide protection against fires and smoke in a swift and precise manner.

10 Claims, 6 Drawing Sheets

FIRE PREVENTION ASSEMBLY

BACKGROUND OF THE INVENTION

1. Field of the Invention

The invention generally relates to a fire prevention assembly installed to a fire prevention gate. More particularly, the invention relates to a fire prevention assembly, in which a sensor unit melts at a certain high temperature, causing a movable piece to move away from the position limiting plate of an actuating device to allow the actuating device to actuate the protective plates of the fire prevention gate.

2. Description of the Prior Art

The fire prevention gate of the prior art is able to close or open the air path upon the occurrence of a fire and discharge the smoke or confine the smoke in a certain space to minimize the damages. The protective plates of the fire prevention gate are actuated by a sensor unit, which is able to actuate an actuating device to open or close the protective plates at a high temperature. Therefore, it is quite important that the sensor unit retain its sensitivity at different temperatures. In the prior art, the sensor unit is of electronic type or mechanical type and is made of a metallic material. Because the air is either acidic or alkaline in many workplaces, such air can cause the sensor unit to corrode or rust and hence its sensitivity could be affected and impeded. Such impediment may lead to a delay in the actuation of the fire prevention gate and may even result in a catastrophe.

From the above, we can see that the fire prevention assembly of the prior art has many disadvantages and drawbacks and needs to be improved. To eliminate the disadvantages of the fire prevention assembly of the prior art, the inventor has put a lot of effort into the subject and has successfully come up with the fire prevention assembly of the present invention.

SUMMARY OF THE INVENTION

The fire prevention assembly of the present invention is installed at a proper location of a fire prevention gate to enable the fire prevention gate to provide protection against fires through the actuation of an actuating device. Also, all the components of the fire prevention assembly of the present invention are made of plastic material. The fire prevention assembly of the present invention comprises a main body, a first connective unit, a tubular piece, a sensor unit, a second connective unit, a first flexible piece, a movable piece and a second flexible piece.

A cylindrical hollow bore is formed in the main body, wherein a first connective area is formed in the frontal part of the main body and a second connective area is formed in the rear part of the main body.

A hole is centrally formed in the outer surface of the first connective unit and another hole is centrally formed in the inside of the first connective unit, so that the first connective unit may be connected with the main body through the engagement between the first connective area of the main body and a connective area formed on the inside of the first connective unit.

The tubular piece is fitted in the cylindrical hollow bore of the main body, wherein a thinner section is formed in the rear portion of the tubular piece and extends out of the main body and a third connective area and a hollow bore are formed in the frontal portion of the tubular piece.

A fourth connective area is formed in the frontal portion of the sensor unit and is connectable with the second connective area; a bore is centrally formed in the sensor unit so that the portion of the tubular piece that extends out of the main body may be fitted in the bore.

A through hole is centrally formed in the second connective unit and a connective area is formed in the rear portion of the second connective unit, so that the second connective unit may be connected with the tubular piece.

The first flexible piece is fitted in the hollow bore of the tubular piece.

A thicker section with a larger diameter is formed in the rear portion of the movable piece and the movable piece is fitted in the hollow bore of the tubular piece. The rear end of the thicker section presses against the frontal end of the first flexible piece and the frontal portion of the movable piece has a smaller diameter to allow it to pass through the through hole of the second connective unit and the hole of the first connective unit.

The second flexible piece is fitted onto the frontal portion of the movable piece and is fitted inside the bore of the main body. One end of the second flexible piece presses against the inner circular surface of the first connective unit and the other end presses against the frontal surface of the second connective unit.

In use, when the sensor unit melts at a high temperature, the first flexible piece and the second flexible piece push the tubular piece rearwards and thus the tubular piece moves rearwards along the axis of the main body. Also, the movable piece will move rearwards along the axis. Therefore, the frontal portion of the movable piece will no longer limit the movement of the actuating device of the fire prevention gate. Thus, the protective plates will be allowed to rotate to open or close the fire prevention gate. In this manner, the fire prevention gate can provide protection against fires and smoke and can discharge the smoke.

These features and advantages of the present invention will be fully understood and appreciated from the following detailed description in view of the accompanying Drawings.

DESCRIPTION OF THE PREFERRED EMBODIMENT

Figure 1:
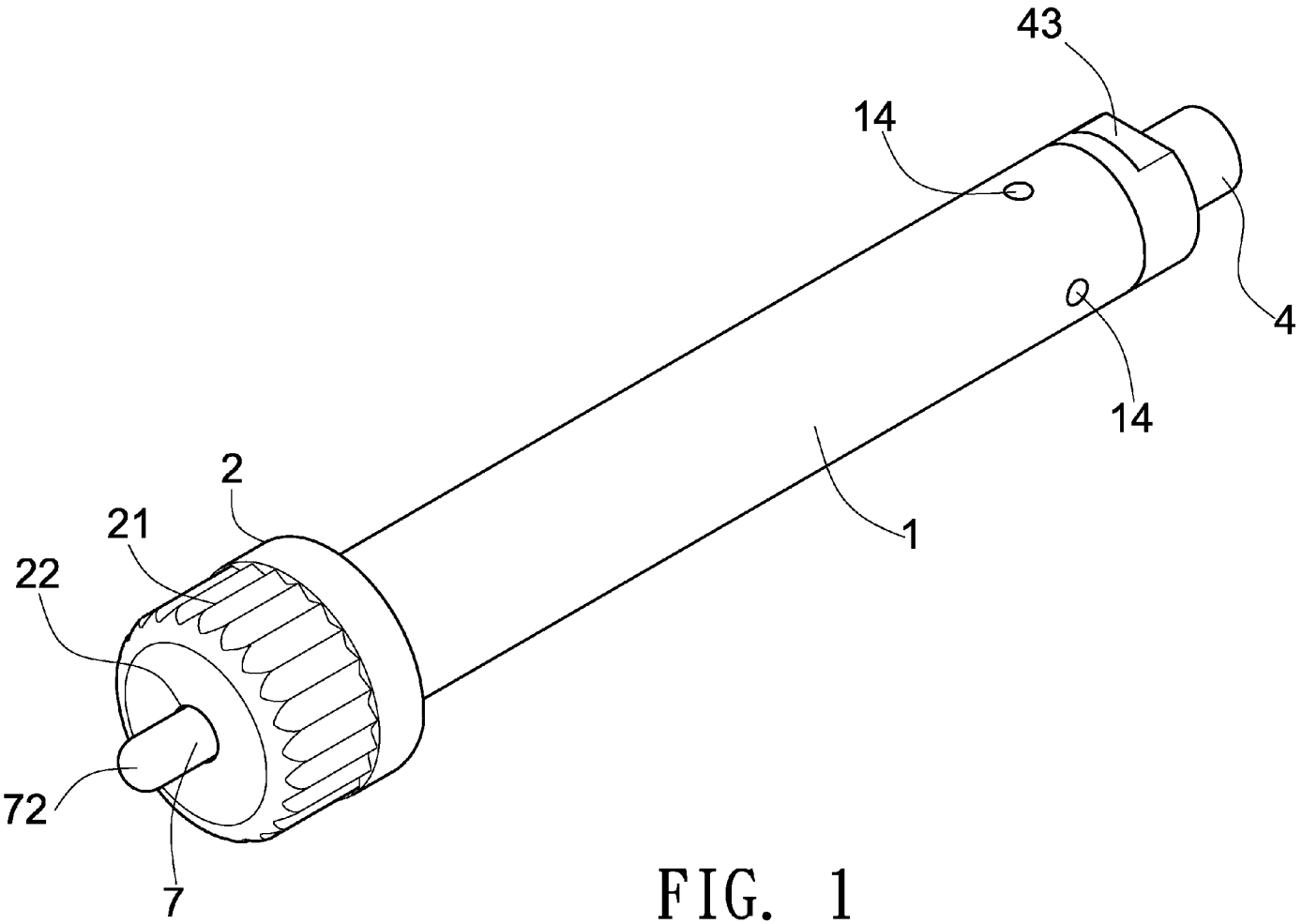
FIG. 1 is a perspective view illustrating the fire prevention assembly of the present invention in an assembled condition.
Figure 2:
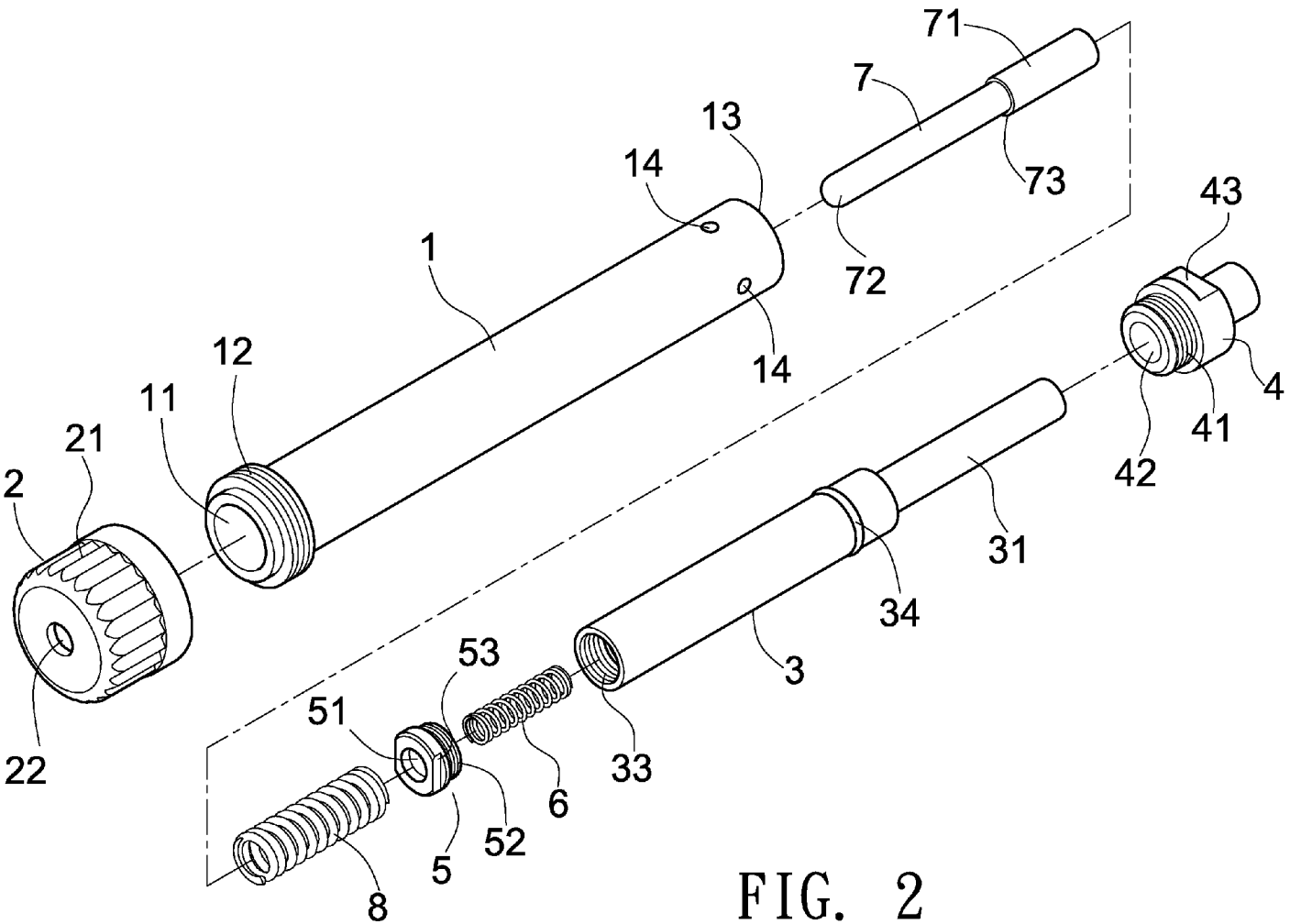
FIG. 2 is a perspective exploded view illustrating the components of the fire prevention assembly of the present invention.
Figure 3:
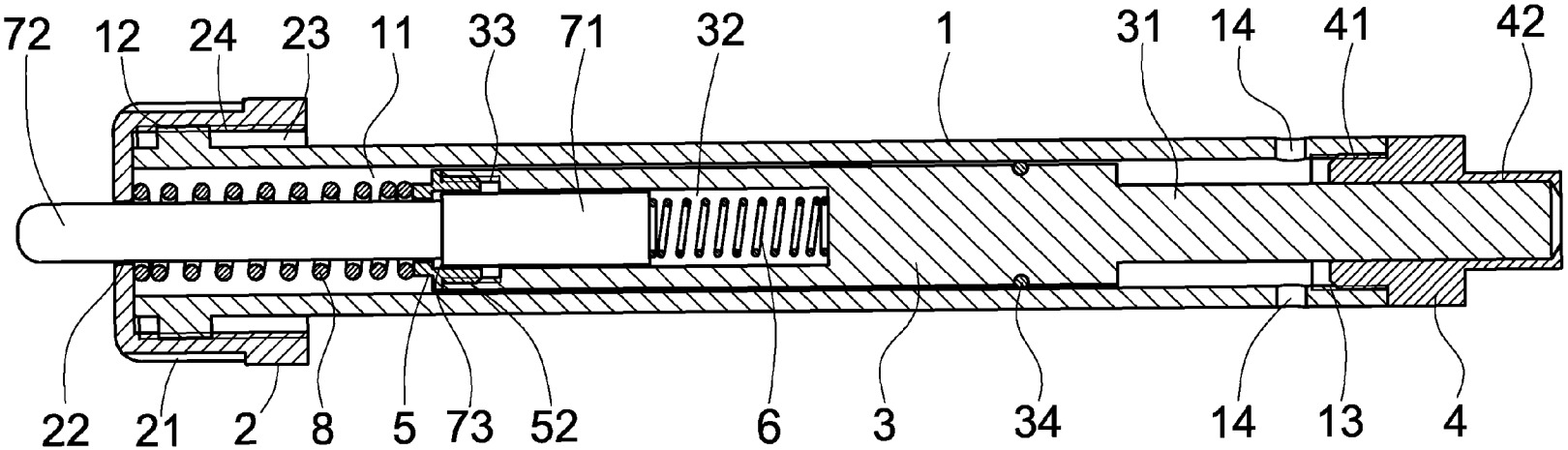
FIG. 3 is a sectional view illustrating the fire prevention assembly of the present invention in an assembled condition.
Figure 4:
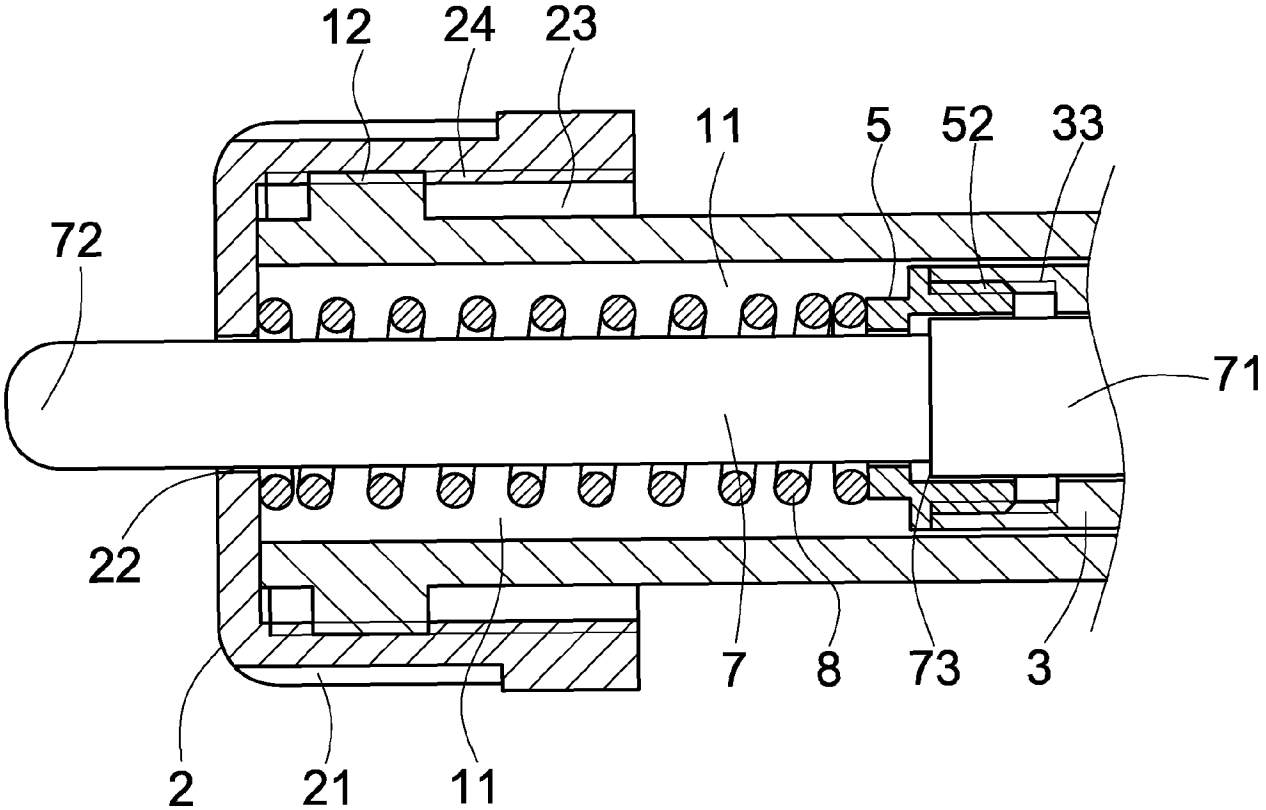
FIG. 4 is a partially enlarged view of FIG. 3.

FIGS. 1 to 6 illustrate the fire prevention assembly of the present invention. The fire prevention assembly of the present invention is installed at a proper place in a frame 91 of a fire prevention gate 9 to limit the movement of an actuating device 93. See FIGS. 2 and 3. Because all the components of the fire prevention assembly of the present invention are made of plastic material, the fire prevention assembly of the present invention would be able to retain its fire detective and preventive functions in an acidic or alkaline environment. Therefore, the fire prevention assembly of the present invention is able to provide quicker and more accurate fire detective and preventive functions. On the other hand, because the sensor unit of the prior art is made of a metallic material, the sensor unit is prone to rusting and corrosion and hence would not be able to actuate the protective plates 92 of the fire prevention gate 9 upon the occurrence of a fire. The fire prevention assembly of the present invention comprises a main body 1, a first connective unit 2, a tubular piece 3, a sensor unit 4, a second connective unit 5, a first flexible piece 6, a movable piece 7 and a second flexible piece 8.

A cylindrical hollow bore 11 is formed in the main body 1. A first connective area 12, which has a male thread and extends radially out of the main body 1, is formed in the frontal part of the main body 1. A second connective area 13, which has a female thread, is formed in the rear part of the main body 1. Several circumferentially arranged through holes 14 are disposed in the main body 1 in a section in front of the second connective area 13.

The first connective unit 2 has the shape of the head portion of a bolt and has several circumferentially arranged indentations 21. The indentations 21 provide an easy and firm grip. A hole 22 is centrally formed in the frontal side of the first connective unit 2 and another hole 23 is centrally formed in the inside of the first connective unit 2. A connective area 24 with a female thread is formed in the inside of the first connective unit 2 around the hole 23. The first connective unit 2 may be connected with the main body 1 through the engagement between the connective area 24 and first connective area 12.

The tubular piece 3 is fitted in the cylindrical hollow bore 11 of the main body 1 and may move axially in the bore 11. A thinner section 31 with a smaller diameter is formed in the rear portion of the tubular piece 3 and a portion thereof extends axially out of the main body 1. Therefore, with the thinner section 31 and the through holes 14, the air in the bore 11 may be discharged out of the main body 1 to facilitate the axial movement of the tubular piece 3 in the bore 11. A hollow bore 32 is formed in the frontal portion of the tubular piece 3. A third connective area 33 with a female thread is formed in the inside of the frontal portion of the hollow bore 32. An O-shape ring 34 is disposed near the middle point of the tubular piece 3.

A fourth connective area 41, which has a male thread, is formed in the frontal portion of the sensor unit 4. The sensor unit 4 may be connected with the main body 1 through the engagement between the fourth connective area 41 and the second connective area 13. A bore 42 is centrally formed in the sensor unit 4 so that the portion of the tubular piece 3 that extends out of the main body 1 may be fitted in the bore 42. Two flat portions 43, which are diagonally opposite each other, are formed in the outer surface of the sensor unit 4 to facilitate the grip of a regular hand tool, such as a wrench.

A through hole 51 is centrally formed in the second connective unit 5. The movable piece 7 passes through the through hole 51. A connective area 52, which has a male thread, is formed in the outside of the rear portion of the second connective unit 5. The second connective unit 5 may be connected with the tubular piece 3 through the engagement between the connective area 52 and the third connective area 33. Two flat portions 53, which are diagonally opposite each other, are formed in the outer surface of the second connective unit 5 to facilitate the grip of a regular hand tool, such as a wrench.

The first flexible piece 6 is a regular spiral spring. The first flexible piece 6 is fitted in the hollow bore 32 of the tubular piece 3. The rear end of the first flexible piece 6 presses against the rear end of the hollow bore 32.

A thicker section 71 with a diameter substantially equal to the diameter of the hollow bore 32 of the tubular piece 3 is formed in the rear portion of the movable piece 7. In addition, the movable piece 7 is fitted in the hollow bore 32 and the rear end of the thicker section 71 of the movable piece 7 presses against the frontal end of the first flexible piece 6. The frontal portion 72 of the movable piece 7 has a small diameter to allow it pass through the through hole 51 of the second connective unit 5 and the hole 22 of the first connective unit 2. In addition, the frontal portion 72 of the movable piece 7 extends axially out of the hole 22 to limit the movement of the position limiting plate 94 of the actuating device 93 of a fire prevention gate 9 so that an actuating unit 95 can not rotate and hence the protective plates 92 can not be rotated and actuated to open or close the gate 9.

A shoulder portion 73 is formed between the frontal portion 72 and the thicker section 71 of the movable piece 7. The shoulder portion 73 presses against the through hole 51 of the second connective unit 5. Therefore, the movable piece 7 may move axially along with the movement of the tubular piece 3.

The second flexible piece 8 is a regular spiral spring and has a diameter larger than that of the first flexible piece 6. The second flexible piece 8 is fitted onto the frontal portion 72 of the movable piece 7 and inside the bore 11 of the main body 1. One end of the second flexible piece 8 presses against the inner circular surface of the first connective unit 2 and the other end presses against the frontal surface of the second connective unit 5.

Figure 5:
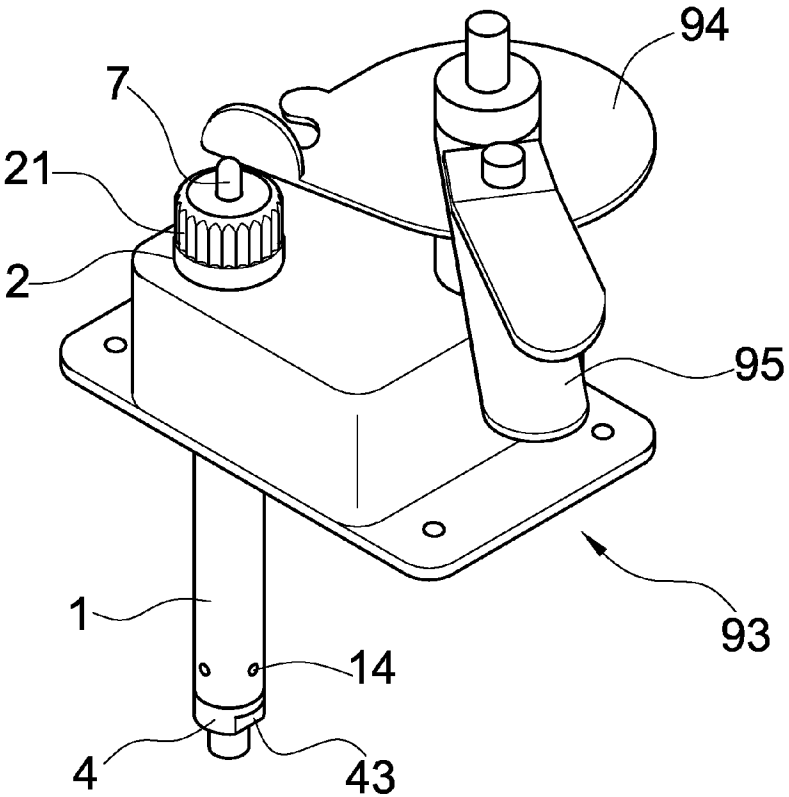
FIG. 5 is a perspective view illustrating the spatial relation between the fire prevention assembly of the present invention and an actuating device of a fire prevention gate.
Figure 6:
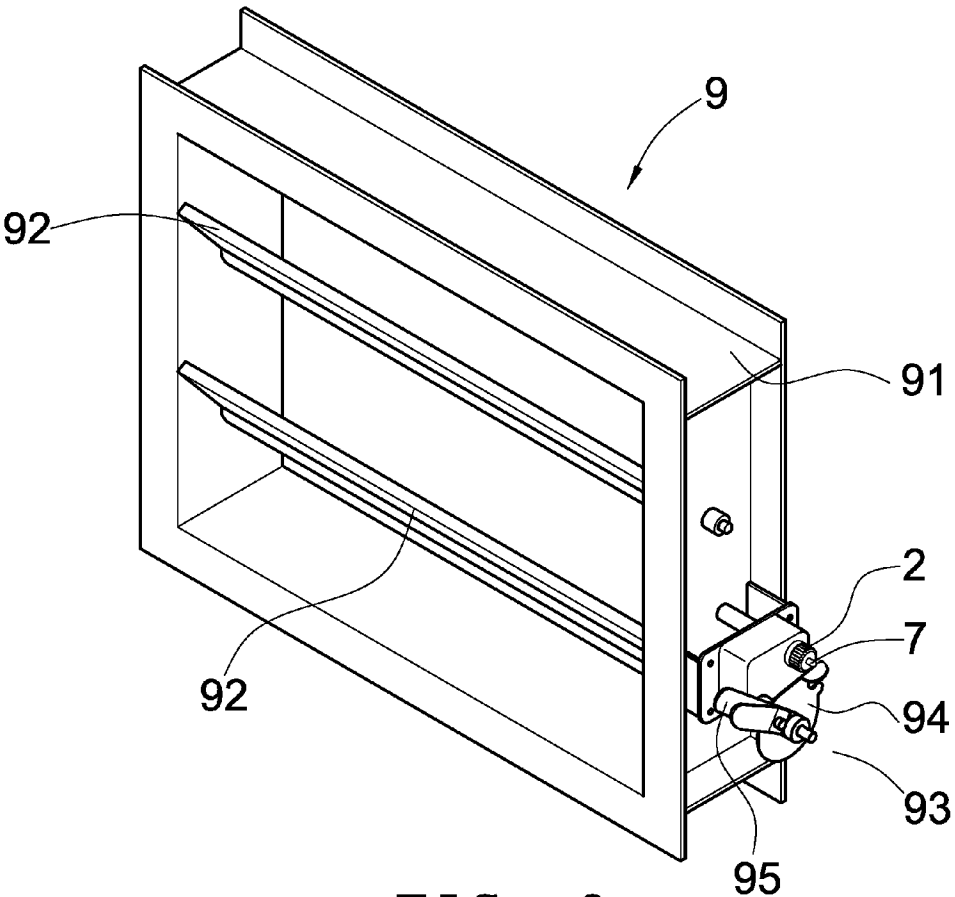
FIG. 6 is a perspective view schematically illustrating how the fire prevention assembly of the present invention is installed to a fire prevention gate.

Now we will explain how the fire prevention assembly of the present invention is used. As illustrated in FIG. 5, the frontal portion 72 of the movable piece 7 can limit the movement of the position limiting plate 94 of the actuating device 93 of a fire prevention gate 9. The rear portion of the sensor unit 4 passes through the frame 91 of the gate 9 and extends into the internal space of the gate 9. The sensor unit 4 can withstand high temperatures and can retain its structure from the room temperature to 90 degree C.; therefore, in this temperature range, the sensor unit 4 does not actuate the actuating device 93 and hence the gate 9 retains its regular functions. If the temperature reaches 90 degree C. for more than one minute, the sensor unit 4 will melt. In such case, the first flexible piece 6 and the second flexible piece 8 pushes the tubular piece 3 rearwards and thus the tubular piece 3 moves rearwards along the axis of the main body 1. Also, the movable piece 7 will move rearwards along the axis. Therefore, the frontal portion 72 of the movable piece 7 will no longer limit the movement of the position limiting plate 94 and the actuating unit 95 will rotate. Thus, the protective plates 92 will be rotated to open or close the fire prevention gate 9. In this manner, the fire prevention gate 9 can provide protection against fires and smoke and can discharge the smoke. Because all components of the fire prevention assembly of the present invention are made of plastic material, the fire prevention assembly of the present invention would be able to retain its fire detective and preventive functions in an acidic or alkaline environment.

In addition, how the protective plates 92 and the fire prevention gate 9 work and their fire detective and preventive functions are known to the people skilled in the art. Therefore, we will not elaborate on them.

Many changes and modifications in the above described embodiments of the invention can, of course, be carried out without departing from the scope thereof. Accordingly, the invention is disclosed and is intended to be limited only by the scope of the appended claims.

What is claimed is:

1. A fire prevention assembly, comprising:

a main body, wherein a cylindrical hollow bore is formed in the main body and wherein a first connective area is formed in the frontal part of the main body and a second connective area is formed in the rear part of the main body;

a first connective unit, wherein a hole is centrally formed in the outer surface of the first unit and another hole is centrally formed in the inside of the first connective unit, and wherein the first connective unit may be connected with the main body through the engagement between the first connective area and a connective area, which is formed in the inside of the first connective unit;

a tubular piece, which is fitted in the cylindrical hollow bore of the main body, wherein a thinner section is formed in the rear portion of the tubular piece and extends axially out of the main body and a third connective area and another hollow bore are formed in the frontal portion of the tubular piece;

a sensor unit, wherein a fourth connective area is formed in the frontal portion of the sensor unit and may be engaged with the second connective area and a bore is centrally formed in the sensor unit so that the portion of the tubular piece that extends out of the main body may be fitted in the bore;

a second connective unit, wherein a through hole is centrally formed in the second connective unit and a connective area is formed in the rear portion of the second connective unit, and wherein the second connective unit may be connected with the tubular piece;

a first flexible piece, which is fitted in the hollow bore of the tubular piece;

a movable piece, wherein a thicker section with a larger diameter is formed in the rear portion of the movable piece and the movable piece is fitted in the hollow bore of the tubular piece, and wherein the rear end of the thicker section presses against the frontal end of the first flexible piece and the frontal portion of the movable piece has a small diameter to allow it to pass through the through hole of the second connective unit and the hole of the first connective unit; and a second flexible piece, which is fitted onto the frontal portion of the movable piece and is fitted inside the bore of the main body, and wherein one end of the second flexible piece presses against the inner circular surface of the first connective unit and the other end presses against the frontal surface of the second connective unit.

2. The fire prevention assembly as in claim 1, wherein the first connective area of the main body has a male thread and extends radially out of the main body and wherein the connective area, which is formed on the inside of the first connective unit, has a female thread.

3. The fire prevention assembly as in claim 1, wherein the second connective area, which has a female thread, is formed in the rear part of the main body, and wherein the fourth connective area of the sensor unit has a male thread and may engage with the second connective area.

4. The fire prevention assembly as in claim 1, wherein the third connective area is formed in the frontal portion of the hollow bore and has a female thread, and wherein the connective area of the second connective unit has a male thread.

5. The fire prevention assembly as in claim 1, wherein a shoulder portion is formed between the frontal portion and the thicker section of the movable piece and the shoulder portion presses against the through hole of the second connective unit.

6. The fire prevention assembly as in claim 1, wherein several circumferentially arranged through holes are disposed in the main body in an area in front of the second connective area and a thinner section with a smaller diameter is formed in the rear portion of the tubular piece and extends out of the main body so that, thanks to the thinner section and the through holes, the air in the bore may be discharged out of the main body to facilitate the axial movement of the tubular piece in the cylindrical hollow bore of the main body.

7. The fire prevention assembly as in claim 1, wherein the first connective unit has the shape of the head portion of a bolt and has several circumferentially arranged indentations to provide easy grip.

8. The fire prevention assembly as in claim 1, wherein two flat portions, which diagonally oppose each other, are formed in the outer surface of the second connective unit to facilitate the grip of a regular hand tool, such as a wrench.

9. The fire prevention assembly as in claim 1, wherein two flat portions, which diagonally oppose each other, are formed in the outer surface of the sensor unit to facilitate the grip of a regular hand tool, such as a wrench.

10. The fire prevention assembly as in claim 1, wherein all the components of the fire prevention assembly of the present invention are made of plastic material.

* * * * *